US008277231B2

(12) United States Patent
Christ et al.

(10) Patent No.: US 8,277,231 B2
(45) Date of Patent: Oct. 2, 2012

(54) ELECTRICAL DEVICE WITH CONTACT ASSEMBLY

(75) Inventors: Johannes Christ, Vaihingeni/Enz (DE); Stefan Luigi Russo, Oberndorf (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 13/058,224

(22) PCT Filed: Aug. 7, 2009

(86) PCT No.: PCT/IB2009/053483

§ 371 (c)(1), (2), (4) Date: Feb. 9, 2011

(87) PCT Pub. No.: WO2010/018511

PCT Pub. Date: Feb. 18, 2010

(65) Prior Publication Data

US 2011/0159750 A1 Jun. 30, 2011

(30) Foreign Application Priority Data

Aug. 14, 2008 (EP) ..... 08105039
Sep. 1, 2008 (EP) ..... 08105196

(51) Int. Cl.
*H01R 9/09* (2006.01)

(52) U.S. Cl. ..... 439/66

(58) Field of Classification Search ..... 439/66, 439/91, 591
See application file for complete search history.

(56) References Cited

U.S. PATENT DOCUMENTS

| | | | | |
|---|---|---|---|---|
| 4,593,961 | A | 6/1986 | Cosmo | |
| 5,338,232 | A | 8/1994 | Bernier | |
| 5,469,841 | A | 11/1995 | Kobayashi et al. | |
| 5,639,247 | A | 6/1997 | Johnson et al. | |
| 5,820,549 | A | 10/1998 | Marian, Jr. | |
| 6,210,173 | B1 * | 4/2001 | Matsunaga | 439/66 |
| 6,217,342 | B1 * | 4/2001 | Neidich et al. | 439/66 |
| 6,261,130 | B1 | 7/2001 | Huynh et al. | |
| 6,814,585 | B2 * | 11/2004 | Bedell et al. | 439/66 |
| 2007/0241971 | A1 | 10/2007 | Tsujimura et al. | |

FOREIGN PATENT DOCUMENTS

WO 2007145128 A1 12/2007

* cited by examiner

*Primary Examiner* — Gary F. Paumen

(57) ABSTRACT

The invention relates to an electrical device with a contact assembly 1 comprising at least one electrical contact 2 having a contacting end 10 for contacting a counterpart contact of another electrical device 14, and a holding device 3 for holding the electrical contact 2, wherein the holding device 3 comprises an elastomeric material 4 in which the electrical contact 2 is elastically held. In this way, an electrical device with such a contact assembly 2 is achieved that provides for a reliable electrical contact while being robust, easy to clean and preferably also watertight.

20 Claims, 3 Drawing Sheets

ELECTRICAL DEVICE WITH CONTACT ASSEMBLY

FIELD OF THE INVENTION

The invention relates to the field of contacting electrical devices, and especially to an electrical device with a robust and easy to clean contact assembly.

BACKGROUND OF THE INVENTION

Electrical devices like medical devices or consumer devices often comprise flat data or charging contacts. Such data or charging contacts may be comprised of turned metal parts, sheet metal parts or printed circuit boards. Typically, such flat data or charging contacts are used in order to achieve a smooth surface that makes the electrical device easy to clean and robust.

For the counterpart electrical device, e.g. a charging station or a data cradle, often spring contacts are used in order to guarantee for a good electrical contact. Usually, these spring contacts are made of flat springs or so-called pogo pins. When the electrical device with the typically flat data or charging contacts is placed onto the counterpart electrical device, the spring contacts are compressed and, hence, a reliable electrical contact is achieved.

However, a disadvantage of this type of spring contacts lies in the fact that they are not easy to clean due to cavities or cracks, and typically, they are not water-tight.

SUMMARY OF THE INVENTION

It is the object of the invention to provide an electrical device with such a contact assembly that provides for a reliable electrical contact while being robust, easy to clean and preferably also water-tight.

This object is achieved by an electrical device with a contact assembly comprising at least one electrical contact having a contacting end for contacting a counterpart contact of another electrical device, and a holding device for holding the electrical contact, wherein the holding device comprises an elastomeric material in which the electrical contact is elastically held.

Accordingly, it is an essential idea of the invention that an electrical device with such a contact assembly is provided which comprises an electrical contact embedded in an elastomeric material in such a way that the contact is elastically held. As a result, a spring function of the contact assembly is achieved without requiring the electrical contact to be a spring itself.

While contacting the counterpart contact of another electrical device is achieved with the contacting end of the electrical contact, the other end of the electrical contact preferably serves for connecting the electrical contact to an electrical circuit. With respect to this, it is especially preferred that on the side of the elastomeric material which is turned away from the contacting of the electrical contact, the electrical contact is electrically connected to a printed circuit board. This connection to the printed circuit board can be a direct connection or a connection by wire.

Further, according to a preferred embodiment of the invention, the electrical contact is provided in an area of the elastomeric material which on the side of the contacting end of the electrical contact is raised relative to the surrounding of this area. According to this preferred embodiment of the invention, the contacting end of the electrical contact is also raised relative to the surrounding area of the elastomeric material which means that in case the counterpart contact of the other electrical device is laid onto the electrical device according to the preferred embodiment of the invention, it can be achieved that only the contacting ends of the electrical contacts of both electrical devices get in touch with each other while other parts of the electrical devices, like their housings, do not touch each other. In this way, due to the fact that the electrical contact of the electrical device according to the preferred embodiment of the invention is elastically held in the elastomeric material, a good contacting force between the contacting ends of the electrical contacts can be achieved and enough stroke required due to tolerances between the electrical contact and the device is provided. Thus, a good and reliable electrical connection is achieved.

In general, the raised area of the elastomeric material can be designed with different geometrical forms. However, according to a preferred embodiment of the invention, the raised area of the elastomeric material is, at least partly, convex. Such a design helps to achieve above-mentioned effect of having a contact essentially only in the area of the contacting ends.

Further, the contacting end of the electrical contact may be designed in different ways. For example, the contacting end can be flat. However, according to a preferred embodiment of the invention, the contacting end of the electrical contact is, at least partly, convex. In this way, almost a "point-to-point" connection between the contacting ends of the electrical contact can be achieved.

Generally, the electrical contact can be provided in the elastomeric material in different ways, e.g. preferably the electrical contact is injected or inserted into the elastomeric material. According to a preferred embodiment of the invention, with respect to this, the electrical contact is sealed in the elastomeric material. In this way, especially, water-tightness can be achieved which is especially advantageous for cleaning the device.

In general, the elastomeric material can be arranged in different locations and in different parts of the electrical device. However, according to a preferred embodiment of the invention, the elastomeric material is part of the housing of the electrical device. In this way, the interior of the electrical device can be sealed relative to the outside in an easy and reliable way.

According to another preferred embodiment of the invention, the elastomeric material comprises a, preferably circumferential, groove which is surrounding the electrical contact. Though the flexibility of the elastomeric material itself, in general, might be sufficient for elastically holding the electrical contact, according to this preferred embodiment of the invention, the flexibility of the elastic material is even increased by providing a groove surrounding the electrical contact. Since in the area of this groove the thickness of the elastomeric material is less, flexible movements of the electrical contact can be initiated in an easier way. In general, such a groove can be provided on one or on both sides of the elastomeric material. However, according to a preferred embodiment of the invention, the groove is only provided on the side of the elastomeric material which is turned away from the contact end. In this way, the elasticity of the elastomeric material is increased without loosing a flat outer surface of the electrical device, the surface thus being robust and easy to clean.

As already stated above, in general, the elasticity of the elastomeric material might be sufficient for providing a reliable electrical contact to a counterpart contacting end of the other electrical device. However, according to a preferred embodiment of the invention, the electrical contact comprises a spring for pressing against the counterpart contact of the other electrical device. Such a spring preferably comprises a pogo pin and/or a flat spring which presses onto the end of the electrical contact which is turned away from the contacting end. For the flat spring, for example, a standard battery contact with a flat spring or other standard contacts with integrated springs can be used.

For the elastomeric material, different materials can be used. According to a preferred embodiment of the invention, the elastomeric material comprises silicone. Silicone has proven to be easy to process and reliable in operation of the electrical device.

In general, the electrical contact can be a one-part piece. However, according to a preferred embodiment of the invention, the electrical contact is at least two-part, having a first part comprising the contacting end for contacting the counterpart contact of the other electrical device, and a second part elastically abutting against the first part. Further, with respect to this preferred embodiment of the invention, the first part and the second part of the electrical contact are elastically held in the elastomeric material in such a way that a movement of the first part relative to the second part in a direction perpendicular to the longitudinal axis of the electrical contact is made possible. In this way, shearing forces acting on the contacting end of the electrical contact due to the other electrical device are essentially not transferred to the second part of the electrical device which is advantageous with respect to its durability.

Further, in general, the contact assembly described above is suitable for a wide variety of electrical devices. However, according to a preferred embodiment of the invention, the electrical device comprises a charging station or/and a data cradle. With respect to this, the electrical contact preferably is a data or/and a charging contact.

The invention also relates to a set of electrical devices with at least a first electrical device as described above and with at least a second electrical device having a counterpart electrical contact, wherein the contact assembly for the first electrical device is adapted for pressing the contacting end of the electrical contact of the first electrical device against a contacting end of the second electrical device. As already described above, in this way, a reliable electrical contact between the two devices can be achieved in an easy way.

With respect to this, according to a preferred embodiment of the invention, the contacting end of the second electrical device comprises a flat contact end. Such a flat contact end is easy to manufacture and further easy to clean.

According to a further preferred embodiment of the invention, the counterpart electrical contact of the second electrical device is integrated into the housing of the second electrical device in such a way that the flat contact end is flush with the outer side of the housing of the second electrical device. This means that according to this preferred embodiment of the invention a second electrical device is achieved which comprises a flat outside wall even in the area of the electrical contacts which makes even this area easy to clean and unsusceptible for damage of the electrical contacts.

BRIEF DESCRIPTION OF THE DRAWINGS

These and other aspects of the invention will be apparent from and elucidated with reference to the embodiments described hereinafter.

In the drawings.

DETAILED DESCRIPTION OF EMBODIMENTS

Figure 1:
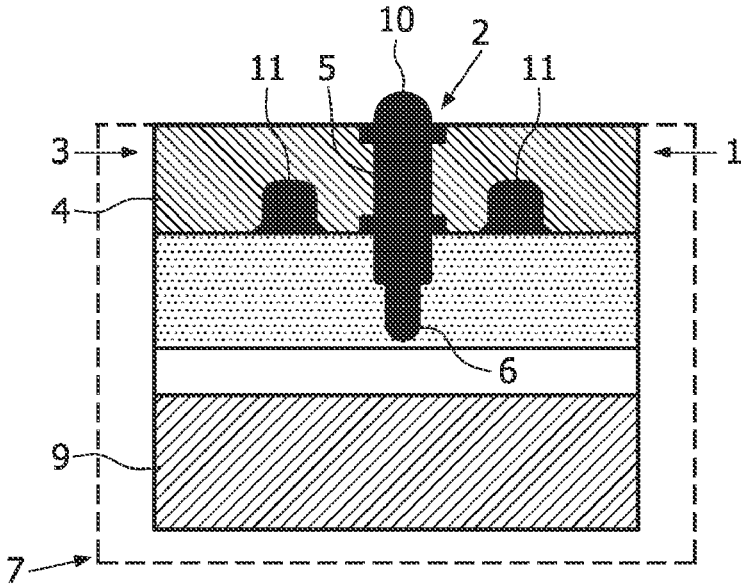
FIG. 1 schematically depicts an electrical device in a cross-sectional view according to a first embodiment of the invention, FIG. 2 schematically depicts an electrical device in a cross-sectional view according to a second embodiment of the invention, FIG. 3 schematically shows the charging area of an electrical device according to a third embodiment of the invention, FIG. 4 schematically shows a counterpart electrical device of a set of electrical devices according to another preferred embodiment of the invention, and FIG. 5 schematically depicts an electrical device in a cross-sectional view according to still another embodiment of the invention.

From FIG. 1, a schematical depiction of an electrical device according to a first embodiment of the invention can be seen as a cross-sectional view. The electrical device comprises a contact assembly 1 with an electrical contact 2 which is held in a holding device 3 made of an elastomeric material 4. The electrical contact 2 is designed as a pogo pin comprising an upper part 5 and a lower part 6, the lower part 6 being elastically slidable into and out of the upper part 5, respectively.

The electrical contact 2 is sealed into the elastomeric material of the holding device 3 which is part of the housing 7 of the electrical device. In this way, the interior of the electrical device can be sealed against the intrusion of water or the like. Further, the lower part 6 of the electrical contact 2 is directly connected to a printed circuit board 9 and in this way makes contact to the electrical circuits of the electrical device. On the other side of the electrical contact 2, i.e. the upper part 5, the electrical contact 2 comprises a contacting end 10 for contacting a counterpart contact of another electrical device (not shown in FIG. 1). In order to increase the flexibility of the contact assembly, i.e. the elastomeric material 4, the holding device 3 comprises a groove 11 which is surrounding the electrical contact 2.

Figure 2:
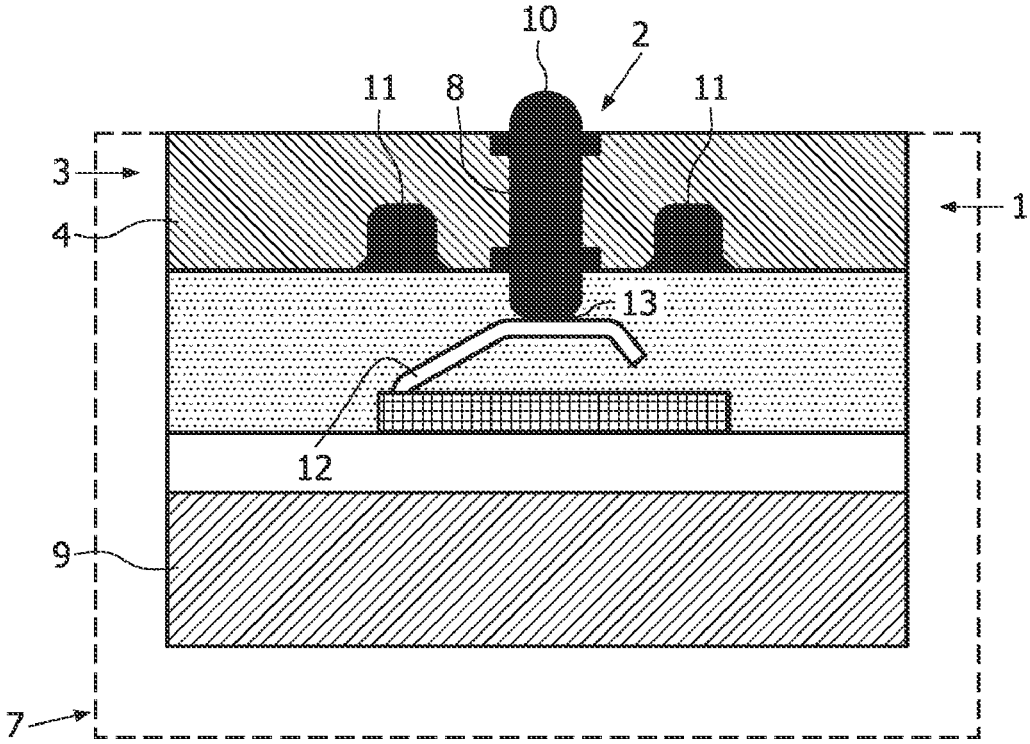

From FIG. 2, a cross-sectional view of an electrical device according to a second embodiment of the invention can be seen. This embodiment is similar to the one shown in FIG. 1, wherein the electrical contact 2 is not provided as a pogo pin but as a one-part pin 8 which is contacting a flat spring 12 at its lower end 13. For the rest, the design of the electrical device according to the second embodiment of the invention is essentially the same as for the first embodiment of the invention shown in FIG. 1.

Figure 3:
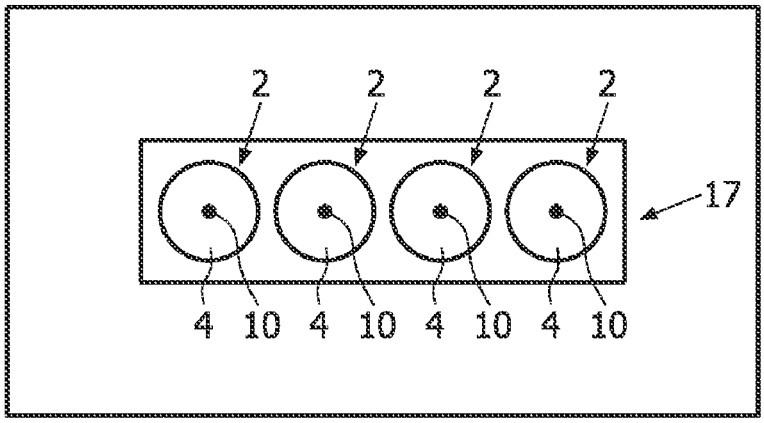

As shown in FIG. 3, which is a schematical top view of a device according to a preferred embodiment of the invention, such a device can be provided with multiple electrical contacts 2. In the present case the electrical device is a charging station provided with a charging area 17 which is formed by four electrical contacts 2 arranged along a common line. Here it can be seen that the elastomeric material 4 on the side of the contacting ends 10 of the electrical contacts is raised relative to the surroundings, i.e. the elastomeric material in this regions is essentially convex. In this way it can be achieved that the contacting ends 10 only get in touch with respective corresponding contacts of another electrical device, while other parts of the electrical devices, like their housings, do not touch each other. In this way, a good contacting force is achieved and, thus, a good and reliable electrical connection is achieved.

Figure 4:
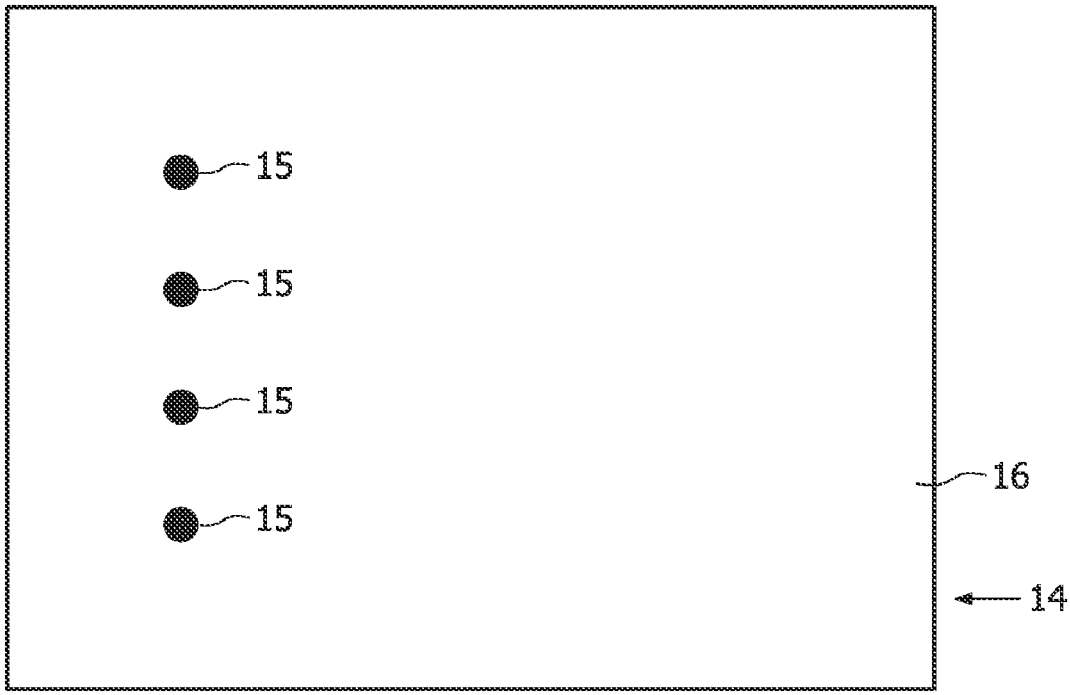

This is also especially advantageous for a counterpart electrical device 14 of a set of electrical devices according to another embodiment of the invention shown in FIG. 4 in a schematical view from its bottom. This counterpart electrical device 14 comprises flat contact ends 15 which are flush with the outside 16 of the housing 17 of the counterpart electrical device 14. In this way, a robust and easy to clean surface of the counterpart electrical device 14 is achieved.

Figure 5:
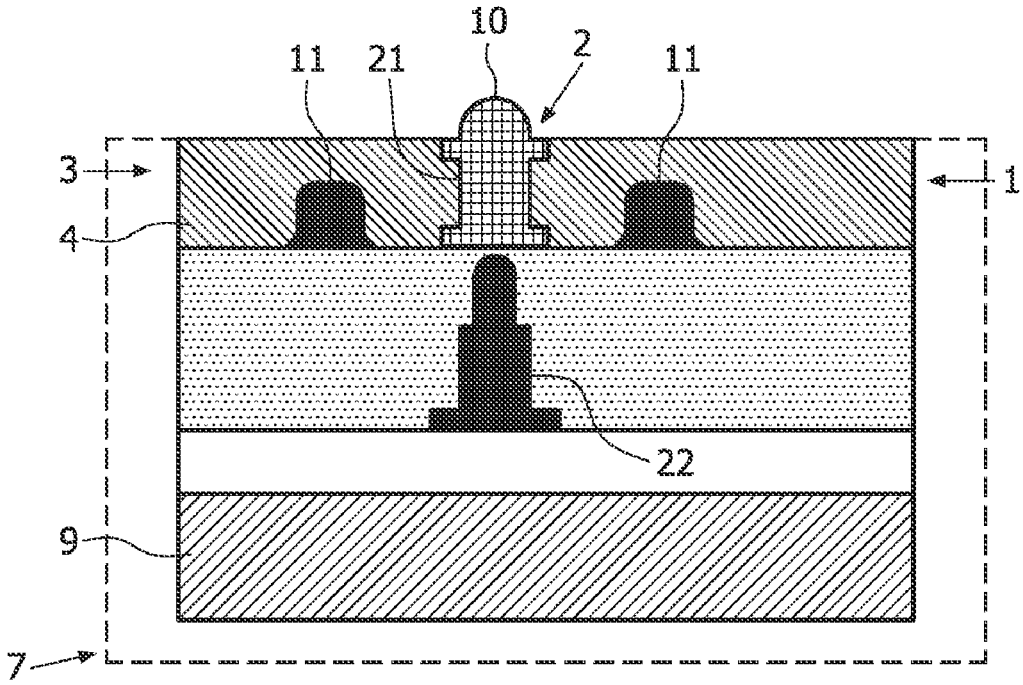

Finally, from FIG. 5 a schematically cross-sectional view of an electrical device according to still another embodiment of the invention can be seen. According to this embodiment of the invention, the electrical contact 2 is a two-part piece, having a first part 21 and a second part 22. The first part 21 comprises the contacting end 10 for contacting the counterpart contact of the other electrical device 14 while the second part 22 elastically abuts against the first part 21. Further, with respect to this preferred embodiment of the invention, the first part 21 and the second part 22 of the electrical contact 2 are elastically held in the elastomeric material 4 in such a way that a movement of the first part 21 relative to the second part 22 in a direction perpendicular to the longitudinal axis of the electrical contact 2 is made possible. In this way, shearing forces acting on the contacting end 10 of the electrical contact 2 due to the other electrical device 14 are essentially not transferred to the second part 22 of the electrical device.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An electrical device with a contact assembly comprising at least one electrical contact having a contacting end for contacting a counterpart contact of another electrical device, and a holding device for holding the electrical contact, wherein the holding device comprises an elastomeric material in which the electrical contact is elastically held, and wherein the electrical contact comprises a spring for pressing against the counterpart contact of the other electrical device.

2. The electrical device according to claim 1, wherein the elastomeric material on the side of the contacting end of the electrical contact is raised relative to the surrounding area.

3. The electrical device according to claim 2, wherein the raised area of the elastomeric material is, at least partly, convex.

4. The electrical device according to claim 1, wherein contacting end of the electrical contact is, at least partly, convex.

5. The electrical device according to claim 1, wherein the electrical contact is sealed in the elastomeric material.

6. The electrical device according to claim 1, wherein the electrical device comprises a housing, and the elastomeric material is part of the housing of the electrical device.

7. The electrical device according to claim 1, wherein the elastomeric material comprises a groove surrounding the electrical contact.

8. The electrical device according to claim 7, wherein the groove is provided on the side of the elastomeric material which is turned away from the contacting end.

9. The electrical device according to claim 1, wherein electrical contact is at least two-part, having a first part comprising the contacting end for contacting the counterpart contact of the other electrical device, and a second part elastically abutting against the first part.

10. The electrical device according to claim 1, wherein on the side of the elastomeric material which is turned away from the contacting end of the electrical contact, the electrical contact is electrically connected to a printed circuit board.

11. The electrical device according to claim 1,herein the device comprises a charging station or/and a data cradle.

12. A set of electrical devices with at least a first electrical device according to claim 1, and with at least a second electrical device having a counterpart electrical contact, wherein the contact assembly of the first electrical device is adapted for pressing the contacting end of the electrical contact of the first electrical device against a contacting end of the second electrical device.

13. The set according to claim 12, wherein the contacting end of the second electrical device comprises a flat surface.

14. The set according to claim 13, wherein the counterpart electrical contact of the second electrical device is integrated into the housing of the second electrical device in such a way that the flat contact end is flush with the outside of the housing of the second electrical device.

15. An electrical device with a contact assembly comprising at least one electrical contact having a contacting end for contacting a counterpart contact of another electrical device, and a holding device for holding the electrical contact, wherein the holding device comprises an elastomeric material in which the electrical contact is elastically held, wherein the electrical contact is provided in an area of the elastomeric material on the side of the contacting end of the electrical contact is raised relative to the surrounding area.

16. The electrical device according to claim 15, wherein the electrical contact comprises a spring for pressing against the counterpart contact of the other electrical device.

17. The electrical device according to claim 15, wherein contacting end of the electrical contact is, at least partly, convex.

18. The electrical device according to claim 15, wherein the electrical contact is sealed in the elastomeric material.

19. The electrical device according to claim 15, wherein the electrical device comprises a housing, and the elastomeric material is part of the housing of the electrical device.

20. A set of electrical devices with at least a first electrical device according to claim 15, and with at least a second electrical device having a counterpart electrical contact, wherein the contact assembly of the first electrical device is adapted for pressing the contacting end of the electrical contact of the first electrical device against a contacting end of the second electrical device.

* * * * *